United States Patent [19]

Klimowicz

[11] 4,316,549

[45] Feb. 23, 1982

[54] RAILWAY CAR COUPLER

[75] Inventor: Richard F. Klimowicz, W. Seneca, N.Y.

[73] Assignee: Dresser Industries, Inc., Dallas, Tex.

[21] Appl. No.: 139,491

[22] Filed: Apr. 11, 1980

[51] Int. Cl.[3] ..... B61G 3/08

[52] U.S. Cl. ..... 213/127; 213/115; 213/125

[58] Field of Search ..... 213/115, 120, 125–127, 213/131, 132, 135, 136, 139, 145–148, 151

[56] References Cited

U.S. PATENT DOCUMENTS

| | | | |
|---|---|---|---|
| 467,249 | 1/1892 | Gilbert | 213/125 |
| 785,250 | 3/1905 | Caskey | 213/120 |
| 1,672,875 | 6/1928 | Bazeley | 213/127 |
| 1,932,503 | 10/1933 | Bazeley | 213/127 |
| 2,617,539 | 11/1952 | Metzger | 213/120 |
| 2,948,414 | 8/1960 | Metzger | 213/127 |
| 3,168,202 | 2/1965 | Cope | 213/146 |
| 3,698,570 | 10/1972 | Metzger | 213/146 |

*Primary Examiner*—Randolph A. Reese
*Attorney, Agent, or Firm*—J. N. Hazelwood; B. E. Deutsch

[57] ABSTRACT

A railway car coupler includes a knuckle locked in a closed position and movable into an open position upon opening of the lock and actuation of a thrower arm engaging the knuckle. The thrower arm is configured to limit the shortening of the knuckle opening moment during the knuckle opening movement.

3 Claims, 14 Drawing Figures

KNUCKLE CLOSED

KNUCKLE OPEN 7°

KNUCKLE OPEN 28°-30'

KNUCKLE OPEN 55°-30'

KNUCKLE OPEN 68°

PRIOR ART

KNUCKLE CLOSED

KNUCKLE OPEN 7°

KNUCKLE OPEN 28°-30'

KNUCKLE OPEN 55°-30'

KNUCKLE OPEN 68°

RAILWAY CAR COUPLER

BACKGROUND OF THE INVENTION

This invention relates to railway car couplers and, in particular, to an improved thrower arm utilized to open the knuckle of the coupler.

In knuckle-type couplers, such as the Association of American Railroad's standard F coupler, the knuckle is swung open by means of a horizontaly positioned knuckle thrower which is mounted for rotation about a vertical axis and which has an arm that bears against a pad on the knuckle in response to actuation of an uncoupling mechanism. As the knuckle thrower rotates, the force exerted by the end of the thrower arm against the knuckle pad pivots the knuckle about its pivot pin to the open position.

Frequently there is difficulty in throwing open the knuckle of existing couplers. This is due, at least in part, to service wear between certain parts of the knuckle and coupler head which heretofore has impeded such opening.

There have been earlier attempts in the coupler art to solve the same problem. One such earlier attempt involved changing the angle of the knuckle thrower pad in an attempt to make opening the knuckle easier. Another earlier prior art arrangement involved in a redesigned lock in an attempt to solve the same problem. Still further attempts have been made to solve the problem by changing the shape and relationship of the arm of the knuckle thrower engaging the lock, the lock, and the lifter. None of the prior art arrangements have been totally satisfactory.

In particular, none of the prior art arrangements prevent the occurrence of the thrower jamming in the concave surface joining the knuckle thrower pad to the main body of the knuckle under worn conditions. In severe jamming cases, fracture of the thrower has resulted. During operation of the standard thrower, the force exerted on the knuckle pad pulls the knuckle buffing shoulders against the coupler buffing shoulders when the clearance therebetween has been diminished due to rust or damage and/or wear of the pin protector lugs. The resultant jamming of the respective shoulders causes high resistance to opening the knuckle.

Currently, when such high resistance to knuckle opening occurs, excessive force must be applied to the knuckle opening mechanism to achieve knuckle opening. In severe cases, even the application of excessive force is not sufficient to achieve knuckle opening. In such cases, the knuckle must be manually moved by an operator.

SUMMARY OF THE INVENTION

Accordingly, it is an object of this invention to improve railway car couplers.

It is a further object of this invention to improve the mechanical advantage of the knuckle throwing mechanism.

It is a further object of this invention to maintain the thrower in spaced relation from the concave surface formed by the junction of the thrower pad and the knuckle body during knuckle opening movement to prevent jamming.

These and other objects of the present invention are attained in a railway car coupler comprising a head having a lock receiving chamber, a knuckle pivoted to said head and having a closed position and an open position, and a lock mounted in said chamber for locking said knuckle in the closed position. A knuckle thrower is mounted in said head with said lock being movable out of locking position to actuate said thrower to effect opening of said knuckle. The surface of the thrower arm contacting the knuckle pad is configured to limit shortening of the knuckle opening moment during the knuckle throwing movement.

DESCRIPTION OF THE PREFERRED EMBODIMENT

Figure 1:
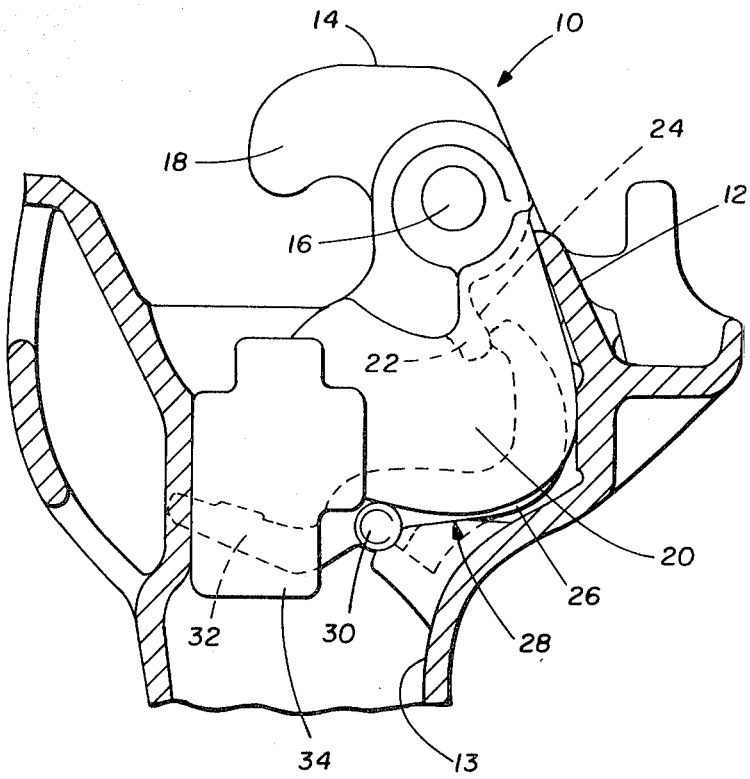
FIG. 1 is a cross-sectional view of a railway car coupler embodying the present invention.

Referring now to the drawings, there is shown a railroad coupler 10 embodying the present invention. In referring to the various figures of the drawings, like numerals shall refer to like parts. The disclosed coupler is illustrated as an A.A.R. (Association of American Railroads) standard F coupler in which the present invention is embodied.

Coupler 10 comprises a head 12 defining a cavity 13. A knuckle 14 is pivotally connected to the head by means of pin protector lugs of vertical pin 16. The knuckle has a nose 18 disposed transversely inwardly of pin 16 as seen in FIG. 1. The knuckle also has a tail 20 which extends rearwardly of pin 16 when the knuckle is in a closed position. The underside of the tail is provided with a pad 22 having a vertical rearwardly extending surface 24 which is adapted to be engaged by leg 26 of knuckle thrower 28. Knuckle thrower 28 is mounted for horizontal pivotable movement about a trunnion 30 which is received in cavity 13 in a position disposed rearwardly of pin 16. Thrower 28 is positioned beneath tail 20 and is formed with a second leg 32 on the side of trunnion 30 opposite from that of leg 26. Leg 32 is adapted to be engaged by lock member 34 when the latter is raised during actuation of the coupler uncoupling mechanism, the construction and operation of which is well known in the art. As the lock is raised out of its locking engagement with knuckle tail 20, its leg is moved rearwardly against thrower leg 32, causing the thrower to pivot about trunion 30, whereby leg 26 thereof, through engagement with surface 24 of pad 22, rotates the knuckle to an open position.

Figure 2:
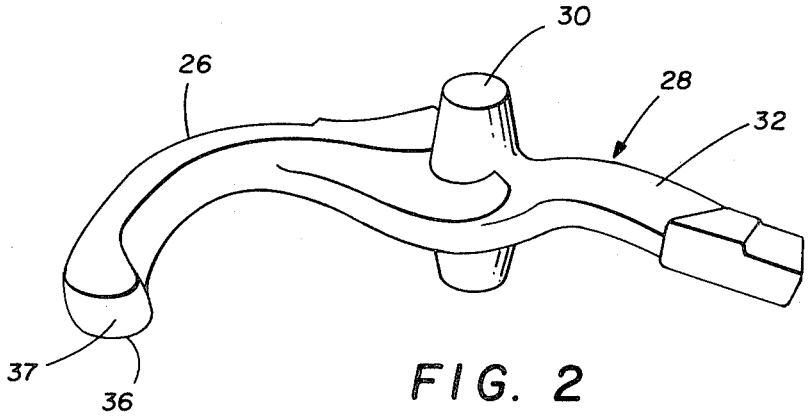
FIG. 2 is a perspective view of a thrower employed in the railway car coupler of FIG. 1.

With specific reference to FIG. 2, modified thrower 28 is shown in detail. Leg 26 of thrower 28 is somewhat shorter than an equivalent thrower leg of the prior art and is provided with a generally cylindrical shaped segment protuberance 37 on the inside surface of end portion 36 for contact with surface 24 of thrower pad 22 of knuckle 14. As shall be more fully explained hereinafter, as thrower 28 moves relative to knuckle 14, different points on the surface of the cylindrical protuberance 37 engage knuckle pad 22 during the knuckle opening movement of the thrower.

Referring specifically now to FIGS. 8–12, there is disclosed a railroad coupler including a thrower 28' designed in accordance with the prior art. FIGS. 8–12 illustrate the thrower moving the knuckle from a knuckle closed position to a knuckle open position.

With specific reference to leg 26' of prior art thrower 28', it will be observed that leg 26' does not terminate in a cylindrically shaped protuberance as does leg 26 of thrower 28 of the present invention. Specifically, leg 26' of thrower 28' has a generally converging portion 36' at the end in engagement with surface 24 of pad 22 of knuckle 14.

The force generated by leg 26' in moving knuckle 14 is designated by the arrow labeled F. The effective length of the moment arm for the force is labeled R. As is well recognized to those skilled in the art, the effective length of moment arm R is the perpendicular distance between the line of action of force F and a line passing through the center of pivot pin 16 of knuckle 14.

Figure 8:
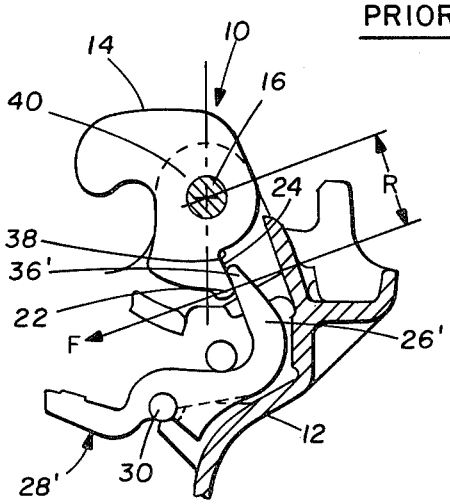
FIGS. 8–12 are views similar to FIGS. 3–7 illustrating the prior art coupler.
Figure 9:
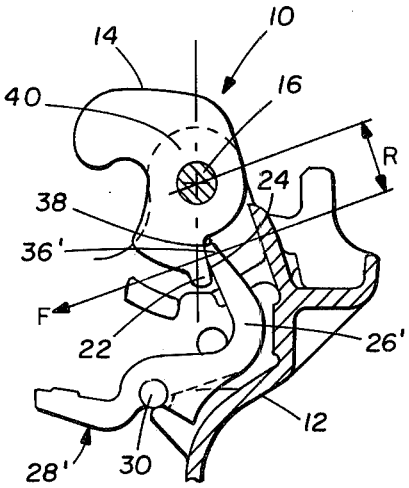

In comparing FIGS. 8 and 9 which illustrate the knuckle as moving from a closed position to a position whereat the knuckle is open 7°, it will be readily observed that the effective length R of the moment arm applied to the opening of knuckle 14 by leg 26' has been significantly reduced. The reduction of the effective length of the moment arm reduces the actual force acting to open the knuckle as such actual force is the product of $F \times R$.

Figure 10:
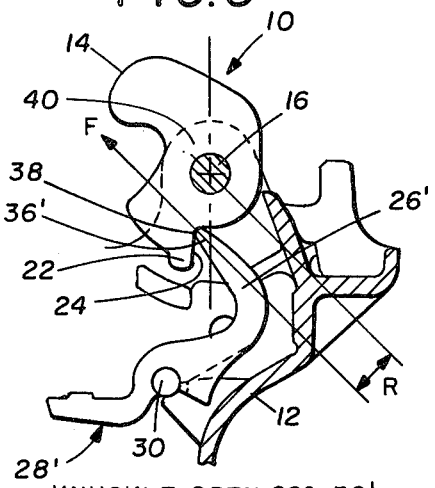

In further comparing FIG. 10 to FIGS. 8 and 9, the knuckle 14 has been rotated to an angle of 28° 30' to further open the knuckle. It will be noted that the effective length R of the moment arm applied to the opening of knuckle 14 by leg 26' has been further reduced, thereby further decreasing the force available to rotate the knuckle. Additionally, it will be observed that end portion 36' of leg 26' has moved into engagement with concave surface 38 joining knuckle pad 22 to the main body 20 of the knuckle. It has been found that some throwers of the type illustrated in FIGS. 8–12 when moved into the position shown in FIG. 10 actually jam to thereby resist further opening of the knuckle. Such jamming of the thrower with respect to the knuckle occurs through movement of the knuckle laterally with respect to the coupler head whereby the buff shoulder of the knuckle engages the buff shoulder of the coupler head. The lateral movement of the knuckle with respect to the head occurs as a result of a portion of force F acting against concave surface 38 as illustrated in FIG. 10. If undue force is exerted on the knuckle opening mechanism, the thrower may be damaged or, in severe cases, broken. Further, when the knuckle is jammed, it becomes necessary for an operator to manually move the knuckle to disengage the buff shoulders. The knuckle and coupler head buff shoulders have not been illustrated in the present drawings as they form no part of the present invention per se and are standard elements of prior art coupling devices.

Figure 11:
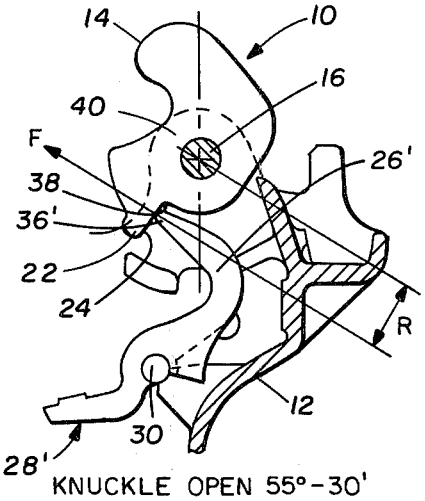
Figure 12:
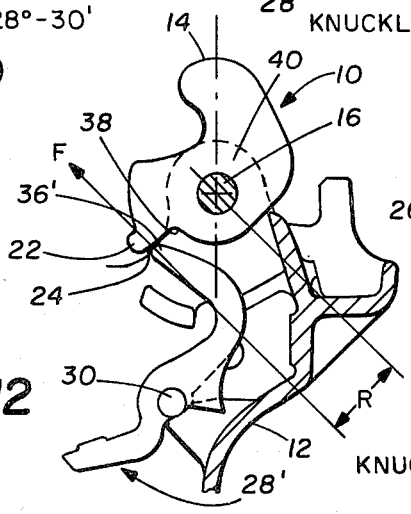

With respect to FIGS. 11 and 12, it will be observed that as the knuckle is further opened through movement of thrower 28', the effective length R of the moment arm applied to the opening of knuckle 14 by the leg 26' increases, thus the minimum force available to open the knuckle occurs at approximately 28° 30' of the knuckle open movement, when in actuality, a much greater force is required due to the possible engagement of the buff shoulders of the coupler head and the knuckle.

Figure 3:
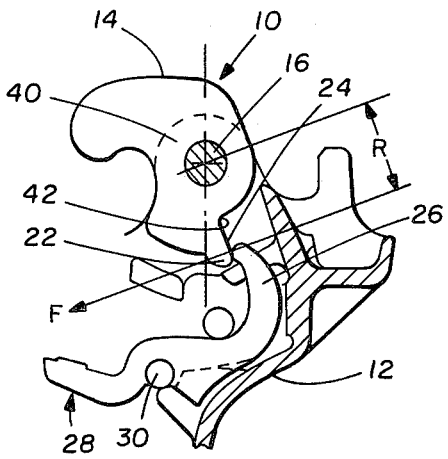
FIGS. 3–7 are somewhat schematic representations illustrating movement of the knuckle from a closed to an open position as a result of utilization of the invention herein disclosed.
Figure 5:
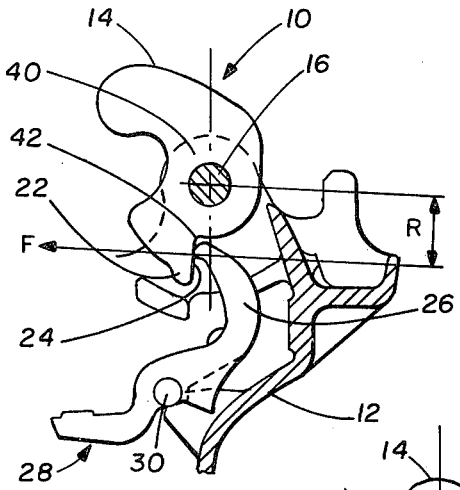
Figure 6:
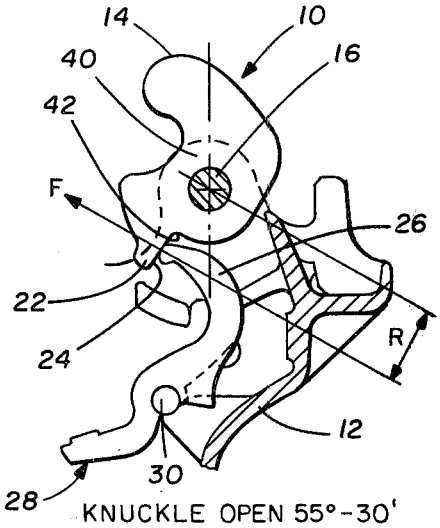
Figure 7:
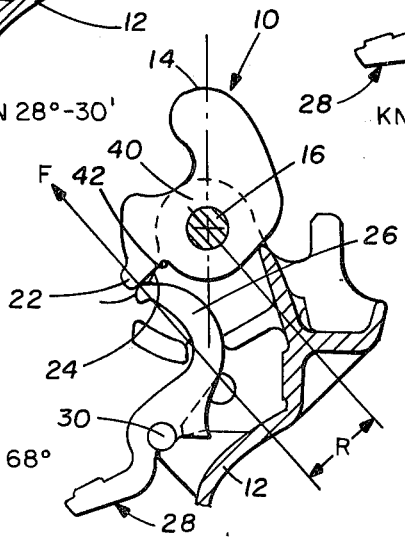

Now referring to FIGS. 3–7, movement of the knuckle from a knuckle closed position as illustrated in FIG. 3 to a knuckle open position as illustrated in FIG. 7 is shown through the utilization of a thrower designed in accordance with the present invention. The position of thrower 28 with respect to knuckle 14 is illustrated at the same degree of knuckle movement as compared to those positions illustrated in FIGS. 8–12.

Figure 4:
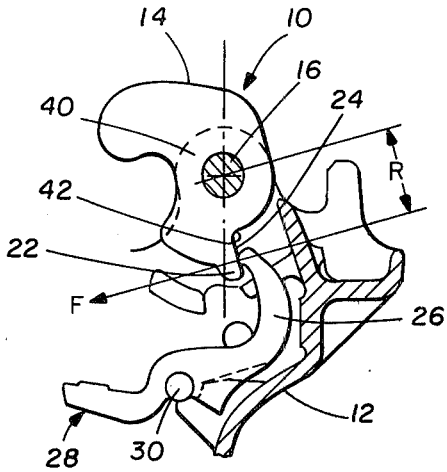

It will be observed with respect to FIG. 3, cylindrical protuberance 37 of leg 26 of thrower 28 engages approximately the tip of surface 24 of pad 22 when the knuckle is in the closed position so the available force for initially turning the knuckle is greater when compared to the available force generated through the use of the thrower of the prior art. In particular, as shown in FIG. 3, the effective length of moment arm R due to the modified shape of end 36 of leg 26 is somewhat greater than the effective length of moment arm R generated by the prior leg 26' as illustrated in FIG. 8. At 7° of knuckle movement, cylindrical protuberance 37 of leg 26 has moved relative to surface 22 such that the effective length of the moment arm generated by leg 26 is somewhat reduced as compared to the length of the moment arm in the initial knuckle closed position. However, the effective length of the moment arm generated by leg 26 as represented by R in FIG. 4 is greater than the effective length of the moment arm generated by leg 26' as represented by R in FIG. 9. Such increase in the effective length of the moment arm results from the modified shape and length of leg 26.

Further in comparing the effective length of the moment arms generated by legs 26 and 26', respectively, shown in FIGS. 5 and 10, when the knuckle has achieved 28° 30' of rotation, it will be readily observed that the effective length of the moment arm generated by leg 26 is significantly greater than the effective length of the moment arm generated by leg 26'. Further with reference to FIG. 5, it will be observed the point of contact of cylindrical protuberance 37 remains spaced from concave surface 38 joining the pad to the main body of knuckle 14. By maintaining cylindrical protuberance 37 spaced from surface 38, the force heretofore generated from the prior art thrower arm tending to move the knuckle laterally with respect to the head is greatly reduced. In effect, the buff shoulder on the knuckle will be maintained in spaced relation with respect to the buff shoulder on the head and not forced into engagement as occurred through use of the prior art thrower. FIGS. 6 and 7 further illustrate movement of the thrower 28 with respect to the knuckle to achieve the full knuckle open position. Again the effective length of the moment arm generated by leg 26 is somewhat greater than the corresponding effective length of the moment arm generated by leg 26' as illustrated in FIGS. 11 and 12. In essence, the cylindrical protuberance of leg 26, as it contacts knuckle pad 22, limits the shortening of the effective length of the moment arm generated during the knuckle opening movement to provide a greater force to achieve the knuckle opening movement as compared to the force generated by the thrower of the prior art as illustrated in FIGS. 8–12.

Figure 14:
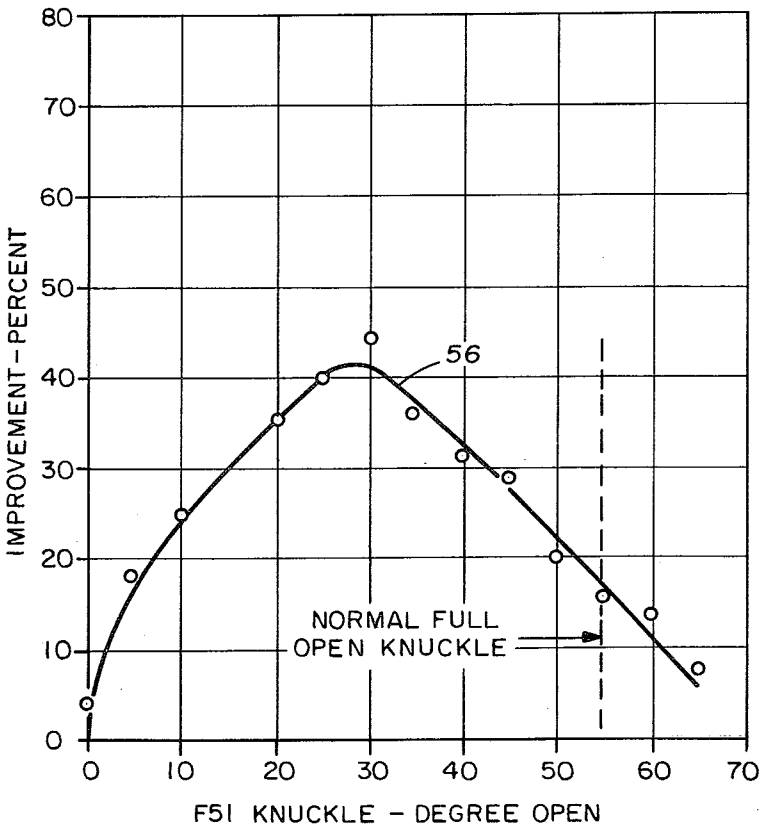
FIGS. 13 and 14 graphically illustrate the improved mechanical advantage and resultant percentage increase in force acting on the knuckle through use of the invention herein disclosed as compared to the prior art couplers.
Figure 13:
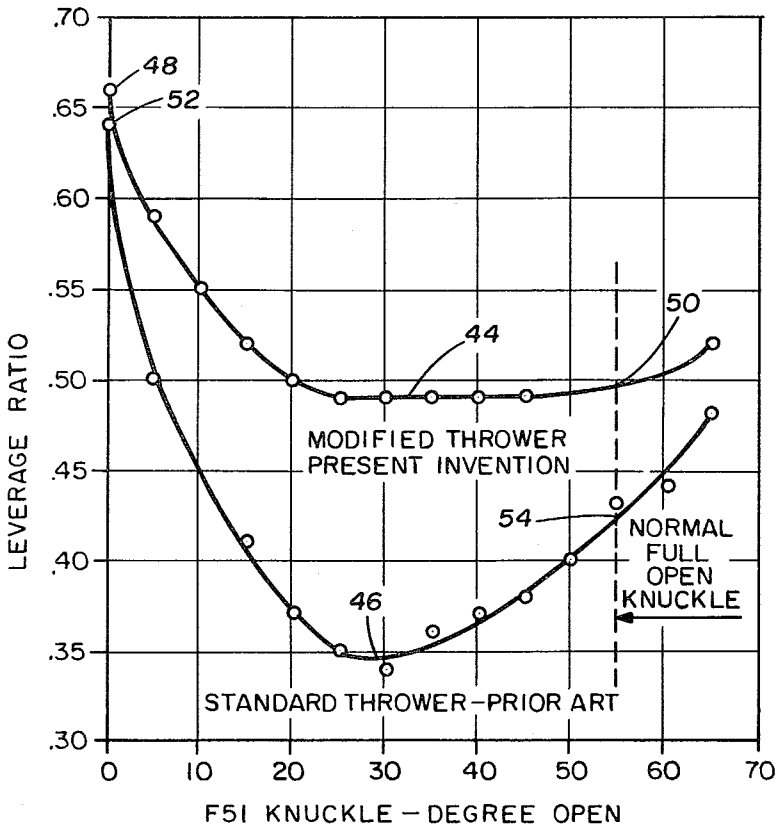

FIGS. 13 and 14 graphically illustrate the improvement achieved through the present invention as compared to the standard or prior art thrower. In particular, in FIG. 13, curve 44 represents the change in the leverage ratio as the thrower moves in opening the knuckle from a closed position at point 48, to a fully open position at point 50. The cylindrical protuberance 37 of end 36 of leg 26, as it contacts knuckle thrower pad 22 limits shortening of the effective length of the moment arm generated by leg 26. The leverage ratio is the ratio between the force applied by the thrower as compared with the force applied to the uncoupling mechanism. Ideally, the ratio would approach unity. For the purposes of developing curves 44 and 46, it is assumed the force applied to the uncoupling mechanism is maintained constant. Similarly, curve 46 illustrates the change in the leverage ratio through use of the prior art thrower in moving the knuckle from a closed to a fully open position. These points are illustrated as 52 and 54, respectively. It will be observed from curve 44, at 28° 30′ the force available has only been diminished by less than $\frac{1}{4}$ as compared to the maximum force available to the start of the knuckle opening movement. Specifically, the leverage ratio is initially approximately 0.67, whereas the leverage ratio at 28° 30′ is only diminished to approximately 0.5. Through use of the standard thrower, the leverage ratio initially is 0.64 and as the thrower moves the knuckle to 28° 30′, the leverage ratio decreases to approximately 0.34, or a little more than half of the total initial force. FIG. 14 illustrates a curve 56 showing the increased percentage of force available through the use of the thrower of the present invention as compared to the thrower of the prior art. Specifically, approximately a maximum 42% increase in the force available to open the knuckle is achieved through use of a thrower in accordance with the present invention.

While the present thrower has been illustrated as being utilized with a standard F coupler, it should be specifically understood that the thrower may be utilized with other couplers.

Essentially, thrower arm 26 has been configured to limit shortening of the effective length of the knuckle opening moment arm as the thrower leg moves relative to the knuckle pad during the knuckle opening movement. Although the moment acting on knuckle pad 22 to open the knuckle decreases from its maximum magnitude, the reduction is relatively small.

While a preferred embodiment of the present invention has been described and illustrated, the invention may be otherwise embodied within the scope of the following claims.

The embodiments of the invention in which an exclusive property or privilege is claimed are defined as follows:

1. A railway car coupler comprising:

a head having a lock receiving chamber;

a knuckle, including a knuckle pad extending from a main body of the knuckle and having a generally concave surface joining the pad to said main body, pivoted to said head and having a closed position and an open position;

a lock in said chamber for locking said knuckle in said closed position; and a pivotable knuckle thrower having first and second outwardly extending legs, said thrower being positioned within said head, said lock being movable out of locking position to engage a first of said legs to pivot said thrower to effect opening of said knuckle, the second of said legs being in engagement with the knuckle and including surface means being configured to effectively shorten the distance from the thrower pivot to the point of engagement between said second thrower leg and said knuckle pad and lengthen the distance between said point of engagement and said knuckle pivot and limit shortening of the effective length of the moment arm generated by said second leg for rotating the knuckle during the knuckle opening movement, the surface means of said second leg remaining in spaced relation relative to said concave surface during the entire knuckle opening movement.

2. A railway car coupler in accordance with claim 1, wherein the surface means of said second leg of said thrower is provided with a generally cylindrically shaped segment protuberance at its inside surface for engagement with the knuckle.

3. A railway car coupler in accordance with claim 2, wherein the cylindrical protuberance comprises a generally convex face, with the face being in engagement with and moving relative to said knuckle such that different points on said face engage said knuckle during the knuckle opening movement.

* * * * *